US007623817B2

(12) United States Patent
Jung et al.

(10) Patent No.: US 7,623,817 B2
(45) Date of Patent: Nov. 24, 2009

(54) FIXING DEVICE AND IMAGE FORMING APPARATUS HAVING THE SAME

(75) Inventors: Chang-hoon Jung, Seoul (KR); Hwan-guem Kim, Seoul (KR); Dong-jin Seol, Suwon-si (KR); Dong-woo Lee, Seoul (KR); Su-ho Shin, Seongnam-si (KR); Tae-gyu Kim, Hwaseong-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 0 days.

(21) Appl. No.: 11/850,977

(22) Filed: Sep. 6, 2007

(65) Prior Publication Data

US 2008/0232871 A1 Sep. 25, 2008

(30) Foreign Application Priority Data

Mar. 20, 2007 (KR) ..... 10-2007-0027227
Apr. 27, 2007 (KR) ..... 10-2007-0041313

(51) Int. Cl.
*G03G 15/20* (2006.01)

(52) U.S. Cl. ..... 399/328; 399/329; 399/331; 219/216

(58) Field of Classification Search ..... 399/328–331
See application file for complete search history.

(56) References Cited

U.S. PATENT DOCUMENTS 3,811,828 A * 5/1974 Ohta et al. ..... 432/227
3,953,709 A * 4/1976 Elter ..... 219/216
7,076,198 B2 * 7/2006 Kim et al. ..... 399/330
7,412,196 B2 * 8/2008 Chen ..... 399/328
2003/0002895 A1 1/2003 Kato et al.
2004/0062578 A1 * 4/2004 Kim et al. ..... 399/328
2004/0151522 A1 * 8/2004 Kato et al. ..... 399/328
2005/0163523 A1 * 7/2005 Omata et al. ..... 399/69
2005/0175380 A1 * 8/2005 Kim ..... 399/328
2005/0265758 A1 12/2005 Haseba et al.
2006/0177251 A1 8/2006 Uehara et al.

FOREIGN PATENT DOCUMENTS

EP 1 580 620 9/2005
EP 1 837 715 9/2007
EP 1 923 752 5/2008

OTHER PUBLICATIONS

European Search Report dated Jul. 21, 2008 issued in EP 08152270.8.

* cited by examiner

*Primary Examiner*—David M Gray
*Assistant Examiner*—G. M. Hyder
(74) *Attorney, Agent, or Firm*—Stanzione & Kim, LLP

(57) ABSTRACT

A fixing device includes a pressing roller, a fixing belt to receive a rotation force transferred from the pressing roller and to rotate thereby, a nip forming member which is mounted inside the fixing belt, the nip forming member including a heat transmission unit formed thereon, and a heat source, which is mounted inside the nip forming member, to simultaneously apply heat to the nip forming member and to the fixing belt through the heat transmission unit.

32 Claims, 5 Drawing Sheets

FIXING DEVICE AND IMAGE FORMING APPARATUS HAVING THE SAME

CROSS-REFERENCE TO RELATED APPLICATIONS

This application claims priority under 35 U.S.C. § 119 (a) from Korean Patent Application Nos. 10-2007-0027227, filed on Mar. 20, 2007, and 10-2007-0041313, filed on Apr. 27, 2007, in the Korean Intellectual Property Office, the disclosure of which are incorporated herein by reference in their entirety.

BACKGROUND OF THE INVENTION

1. Field of the Invention

The present general inventive concept relates to an image forming apparatus. More particularly, the present general inventive concept relates to a fixing device that fixes a toner image onto a printing medium, and an image forming apparatus having the fixing device.

2. Description of the Related Art

Image forming apparatuses, such as printers, copiers, scanners, multi-function machines, or the like, include fixing devices which fix developer images, such as toner images, which are transferred onto sheets of paper by transferring devices known to those skilled in the art.

In order to meet the recent demand for high-speed image forming apparatuses, a rapid temperature increase of nip zones is required so that fixing devices can reach the fixing temperature as rapidly as possible. Additionally, thermal stability is required so that fixing can be performed while maintaining a constant temperature, which is not affected by thermal disturbances, such as a change in the type of paper supplied to the image forming apparatus.

FIGS. 1A to 1C are sectional views schematically illustrating conventional fixing devices. FIG. 1A illustrates a roller-type fixing device, FIG. 1B illustrates a belt-type fixing device, and FIG. 1C illustrates another belt-type fixing device including a nip forming member.

In FIG. 1A, the conventional roller-type fixing device includes a pressing roller 10 and a heating roller 20 which rotate while tightly in contact with each other, and a heat source 30 which is mounted in the heating roller 20.

The conventional roller-type fixing device configured as described above applies heat and pressure onto a non-fixed toner image transferred onto a surface of a sheet of paper P by a transferring device known to those skilled in the art, while the sheet of paper P passes through a nip N formed by pressure contact between the pressing roller 10 and the heating roller 20 which rotate in contact with each other, and then fuses the toner image onto the sheet of paper P. The conventional roller-type fixing device is beneficial in high-speed printing because a temperature decrease when feeding sheets of paper is relatively small. However, since the heating roller 20 has a large thermal capacity, it is difficult to rapidly raise the temperature. The nip N is formed using a pair of rollers 10 and 20, and thus there are limitations to how stably a nip width can be maintained.

Referring to FIG. 1B, another conventional belt-type fixing device includes a pair of pressing rollers 11 and 12 to form a nip N, a fixing belt 22, a tension roller 40 to elastically support one side of the fixing belt 22, and a heat source 31 to apply heat to the fixing belt 22.

The conventional belt-type fixing device configured as described above directly applies heat to the fixing belt 22 using the heat source 31, such as a heat lamp, at a region other than the nip N, and accordingly the fixing belt 22 may have a small thermal capacity. Therefore, the conventional belt-type fixing device is beneficial in a rapid temperature increase. However, a tensile force is applied to rotate the fixing belt 22 which wears out the fixing belt 22. Additionally, the temperature of the fixing belt 22 itself may rise rapidly, but actually the temperature of the nip N may rise at a relatively low rate due to the high level of heat loss which is caused by the fixing belt 22 rotating in contact with the pair of pressing rollers 11 and 12 and with the tension roller 40. In addition, the nip N is formed using the pair of pressing rollers 11 and 12, and thus there are limitations to obtain a stable nip width.

Referring to FIG. 1C, another conventional belt-type fixing device including a nip forming member includes a pressing roller 10, a fixing belt 22 to rotate by a rotation force transferred from the pressing roller 10, a nip forming member 50 to form a nip N at a contact area between the pressing roller 10 and the fixing belt 22, a tension roller 41 to elastically support one side of the fixing belt 22, and a heat source 32 which is mounted in the tension roller 41.

The conventional belt-type fixing device including the nip forming member configured as described above in FIG. 1C enables a width of a nip N to increase, because the nip N is formed by applying pressure to the nip forming member 50. However, when both ends of the nip forming member 50 are pressed against the pressing roller 10 to form the nip N, the nip forming member 50 may be bent, so it is difficult to ensure a stable nip width across the sheet of paper P. Accordingly, edge portions of the sheet of paper P are in complete contact with the pressing roller 10, so that a sufficient nip width can be obtained. However, a central portion of the sheet of paper P is not completely in contact with the pressing roller 10 due to skew of the nip forming member 50, so it is difficult to obtain a sufficient nip width, which thereby causes inferior fixation.

SUMMARY OF THE INVENTION

The present general inventive concept provides a fixing device in which a rapid temperature increase and thermal stability are achieved so that high-speed printing can be realized.

The present general inventive concept also provides a fixing device which can improve fixing properties by maintaining a stable nip width.

The present general inventive concept also provides an image forming apparatus having the above-described fixing devices.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a fixing device including a pressing roller, a fixing belt to receive a rotation force transferred from the pressing roller and to rotate thereby, a nip forming member which is mounted inside the fixing belt, the nip forming member including a heat transmission unit formed thereon, and a heat source, which is mounted inside the nip forming member, to simultaneously apply heat to the nip forming member and to the fixing belt through the heat transmission unit.

The nip forming member may be fixed to guide the rotation of the fixing belt.

The nip forming member may have a substantially cylindrical shape.

The nip forming member may include an elastic body with a predetermined elasticity.

The heat transmission unit of the nip forming member may be formed in a nip zone in the nip forming member.

The heat transmission unit may include a plurality of slits or holes.

The foregoing and/or other aspects and utilities of the present general inventive concept may also be achieved by providing a fixing device including a pressing roller, a fixing belt to receive a rotation force transferred from the pressing roller and to rotate thereby, a nip forming member which is mounted inside the fixing belt, the nip forming member including a first heat transmission unit formed thereon, a supporting pressure member, which is mounted between the fixing belt and the nip forming member, to support and press the nip forming member, the supporting pressure member including a second heat transmission unit formed thereon, and a heat source, which is mounted inside the nip forming member, to simultaneously apply heat to the nip forming member and to the fixing belt through the first and second heat transmission units.

The nip forming member may be formed to enclose the heat source, and may include a body unit including the first heat transmission unit; and a nip zone, which is formed in the body unit, to form a nip at a contact area between the pressing roller and the fixing belt.

The nip zone of the nip forming member may be formed by a lower part of the body unit being extended to a predetermined length.

The nip zone may be formed by both ends of the lower part of the body unit being extended downwards and bent outwards.

The first heat transmission unit of the nip forming member may be formed in the nip zone in the nip forming member.

The supporting pressure member may be fixed in order to guide rotation of the fixing belt.

The supporting pressure member may provide equal support to the nip zone of the nip forming member along the axis while pressing the nip zone of the nip forming member towards the pressing roller.

The supporting pressure member may include a rigid body with a predetermined rigidity.

The first and second heat transmission units may include a plurality of first and second heat transmission units, respectively, and each second heat transmission unit may be disposed in a direction from the heat source corresponding to the direction of a respective first heat transmission unit.

The first and second heat transmission units may include a plurality of slits or holes.

The fixing device may further include a heat insulating member to prevent heat being transferred from the nip forming member to the supporting pressure member.

The heat insulating member may be placed at a contact area between the nip forming member and the supporting pressure member.

The heat insulating member may be formed integrally with the supporting pressure member.

The heat insulating member may have a lower thermal conductivity than the nip forming member.

The heat insulating member may include on of rubber and resin.

The foregoing and/or other aspects and utilities of the present general inventive concept may also be achieved by providing a fixing device including a pressing roller, a fixing belt to receive a rotation force transferred from the pressing roller and to rotate thereby, a nip forming member which is mounted inside the fixing belt, the nip forming member including a heat transmission unit formed thereon, a supporting pressure member to support and press a nip zone of the nip forming member, and a heat source, which is mounted inside the nip forming member, to simultaneously apply heat to the nip forming member and to the fixing belt through the heat transmission unit.

The foregoing and/or other aspects and utilities of the present general inventive concept may also be achieved by providing an image forming apparatus including a photoconductive drum, a developing device to attach a developer onto an electrostatic latent image on the photoconductive medium and to develop the electrostatic latent image, a transferring device to transfer an image developed on the photosensitive medium by the developing device to a printing medium, and a fixing device, as described above, to fix the image transferred to the printing medium.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
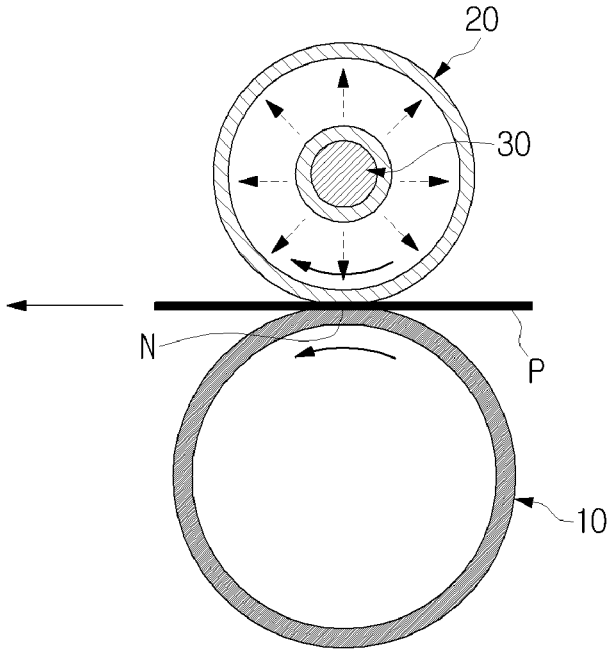
FIG. 1A (PRIOR ART)
FIGS. 1A to 1C are sectional views schematically illustrating conventional fixing devices.
Figure 1B:
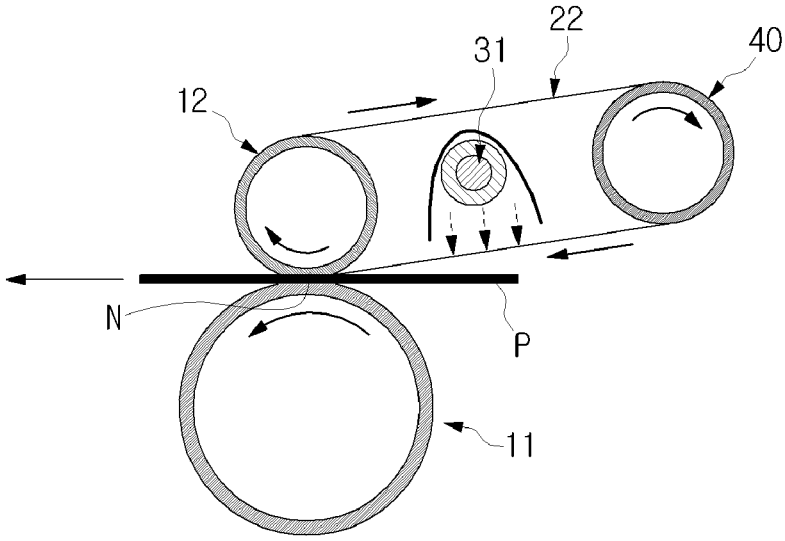
FIG. 1B (PRIOR ART)
Figure 1C:
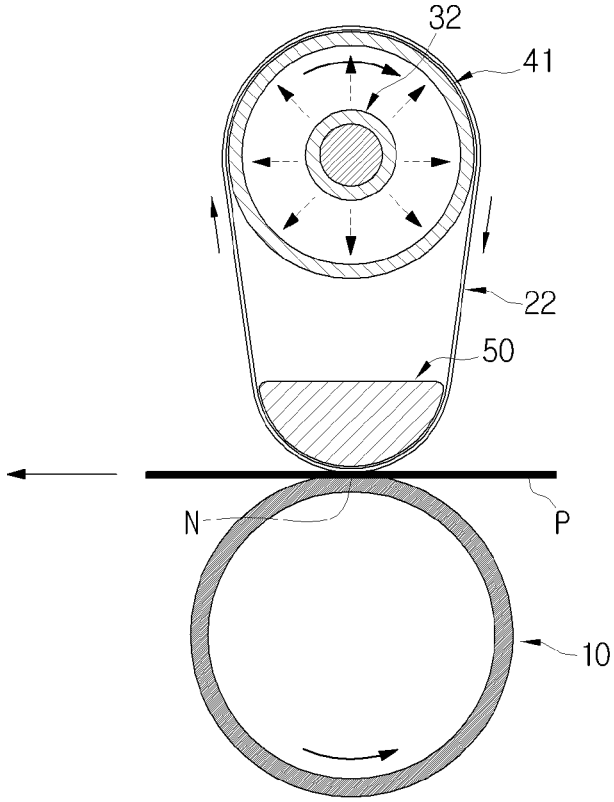
FIG. 1C (PRIOR ART)

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

Figure 2:
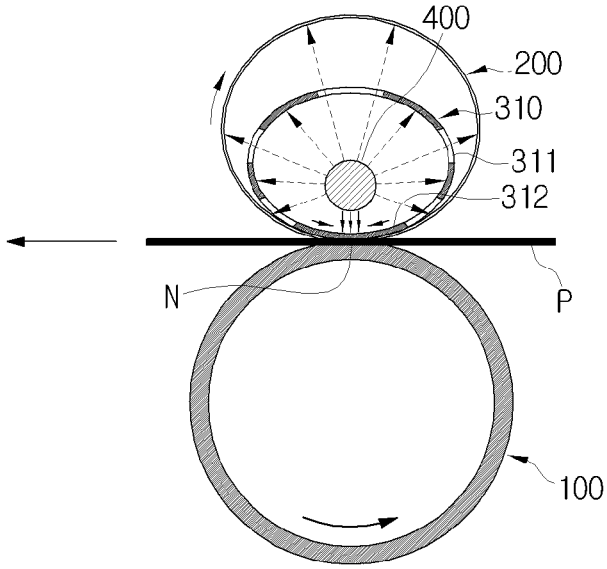
FIG. 2 is a sectional view schematically illustrating a fixing device according to an exemplary embodiment of the present general inventive concept.
Figure 3:
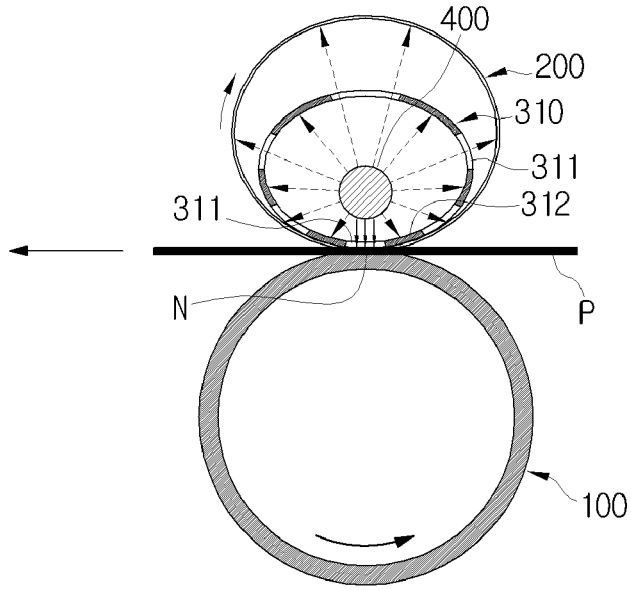
FIG. 3 is a sectional view illustrating an example of the configuration of the fixing device illustrated in FIG. 2 which includes a heat transmission unit in a nip zone of a nip forming member thereof.

FIG. 2 is a sectional view schematically illustrating a fixing device according to an exemplary embodiment of the present general inventive concept, and FIG. 3 is a sectional view illustrating an example of the configuration of the fixing device illustrated in FIG. 2 which includes a heat transmission unit in a nip zone of a nip forming member thereof.

In FIGS. 2 and 3, a fixing device according to an exemplary embodiment of the present general inventive concept may include a pressing roller 100, a fixing belt 200, a nip forming member 310, and a heat source 400.

The pressing roller 100 may receive a driving force and be rotated thereby, in order to press a toner image onto a printing medium, for example, a sheet of paper P, and to fix the toner image onto the printing medium. The pressing roller 100 may be long and cylindrical in shape.

The fixing belt 200 may receive a rotation force from the pressing roller 100 and be rotated thereby, and a nip N may be formed between the pressing roller 100 and the fixing belt 200. The nip N refers to a zone in which the sheet of paper P is held between a contact area of the pressing roller 100 and the fixing belt 200. The fixing belt 200 may be formed of a thermal resistant material, may have a width corresponding to the length of the pressing roller 100, and may have a regular elastic force in order to rotate smoothly. A constant pressurizing force may exist between the pressing roller 100 and the fixing belt 200, in order to fix a toner image onto the sheet of paper P. The fixing belt 200 rotates together with the pressing roller 100 as described in accordance with the exemplary embodiment of the present general inventive concept above, but a separate driving device may be used to rotate the fixing belt 200 instead of the pressing roller 100.

The nip forming member 310 may be mounted inside the fixing belt 200 so that the nip N can be formed at the contact area between the pressing roller 100 and the fixing belt 200. The nip forming member 310 may have a substantially cylindrical shape in order to guide the rotation of the fixing belt 200, and may be fixed on a fixing frame (not illustrated) of the fixing device. The nip forming member 310 may be a metallic elastic body with a predetermined elasticity so that the pressurizing force acting on the pressing roller 100 can be adjusted.

A nip zone 312 of the nip forming member 310 may have various shapes. For example, although not illustrated in the drawings, one side of the nip zone 312 facing the pressing roller 100 may have a curved surface along an outer circumference of the pressing roller 100 in order to improve the fixing efficiency by increasing adhesion to the sheet of paper P. Alternatively, at least one projection may protrude towards the pressing roller 100 at the bottom surface of the nip zone 312 in order to easily feed and discharge sheets of paper P and to prevent the sheets of paper P from jamming.

The nip forming member 310 may include a heat transmission unit 311, and the heat transmission unit 311 may include, for example, a plurality of slits or holes. The plurality of slits or holes may have an elongated shape, and may be formed lengthwise along the outer surface of the nip forming member 310. The plurality of slits or holes may be spaced apart at a predetermined distance. Additionally, the slits or holes may vary in their size and number, in order to adjust the heating rate of the fixing belt 200. For example, in order to increase the heating rate of the fixing belt 200, the slits or holes may have a greater size, and many slits or holes may be used.

Additionally, as illustrated in FIG. 3, the heat transmission unit 311 may also be formed in the nip zone 312 of the nip forming member 310, and accordingly the heat source 400 may directly apply heat to the fixing belt 200 through the heat transmission unit 311 of the nip zone 312. Therefore, it is possible to increase the heating rate of the fixing belt 200. Although the nip forming member 310 may be in contact with the fixing belt 200 only at the nip zone in the exemplary embodiment of the present general inventive concept illustrated in FIGS. 2-3, the general inventive concept is not limited thereto, and the nip forming member 310 may also be in contact with the entire inner circumference of the fixing belt 200 by increasing a diameter of the nip forming member 310. At this time, the nip forming member 310 when heated to a high temperature by the heat source 400 may further apply heat to the fixing belt 200.

The heat source 400 may be mounted inside the nip forming member 310, receive the power from an outside of the fixing device, and may generate and simultaneously apply heat to the nip forming member 310 and to the fixing belt 200 through the heat transmission unit 311. The heat source 400 may be variously implemented as a lamp heater, a heat coil, a plate-shaped heating, or a cylindrical halogen lamp. Although not illustrated in the drawings, the fixing device may include a temperature sensor to detect the temperature of the heat source 400, and a temperature controller to control the temperature of the heat source 400 which is detected by the temperature sensor.

In the fixing device according to the exemplary embodiment of the present general inventive concept, the heat transmission unit 311, including the plurality of slits or holes, and the nip forming member 310 which faces the pressing roller 100 to form the nip N are mounted inside the fixing belt 200 which rotates following a regular cycle while in contact with the pressing roller 100. Additionally, the heat source 400 mounted inside the nip forming member 310 may emit and directly apply heat to the fixing belt 200 and the nip zone 312.

More specifically, the heat emitted from the heat source 400 may be directly applied to the fixing belt 200 through the plurality of slits or holes of the heat transmission unit 311 which are formed in the nip forming member 310. The fixing belt 200 has a small thermal capacity, so the heating rate is very high. In other words, it is possible to obtain a high heating rate by directly heating the fixing belt 200 with a small thermal capacity. In addition, the heat emitted from the heat source 400 may be directly applied to the nip zone 312. The nip zone 312 of the nip forming member 310 has a larger thermal capacity than the fixing belt 200, so it is possible to prevent the temperature of the nip zone 312 from dropping abruptly when feeding the sheets of paper. Accordingly, thermal stability can be achieved, thereby enabling high-speed printing.

Furthermore, if the nip forming member 310 is an elastic body, it is possible to adjust the elastic pressure exerted by the nip forming member 310 on the fixing belt 200, and if the nip forming member 310 is a rigid body, a stable nip width may be ensured because a large pressurizing force is applied to the nip N. Moreover, the closer the nip zone 312 of the nip forming member 310 is to the heat source 400 due to pressurization from the pressing roller 100, the more rapidly the nip zone 312 is heated.

As described above, when the fixing belt 200 and the nip zone 312 are heated simultaneously, the fixing device according to the exemplary embodiment of the present general inventive concept may apply heat and pressure to a non-fixed toner image which is transferred onto the surface of the sheet of paper P passing through the nip N, and may fix the toner image onto the sheet of paper P.

Figure 4:
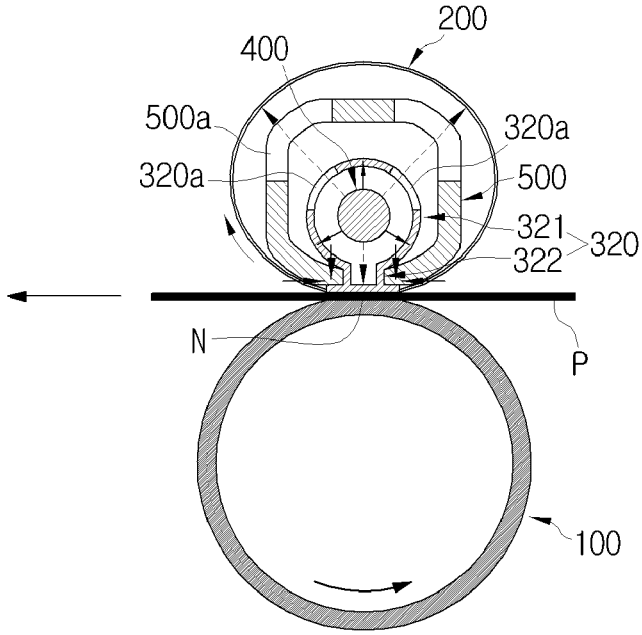
FIG. 4 is a sectional view schematically illustrating a fixing device according to another exemplary embodiment of the present general inventive concept.
Figure 5:
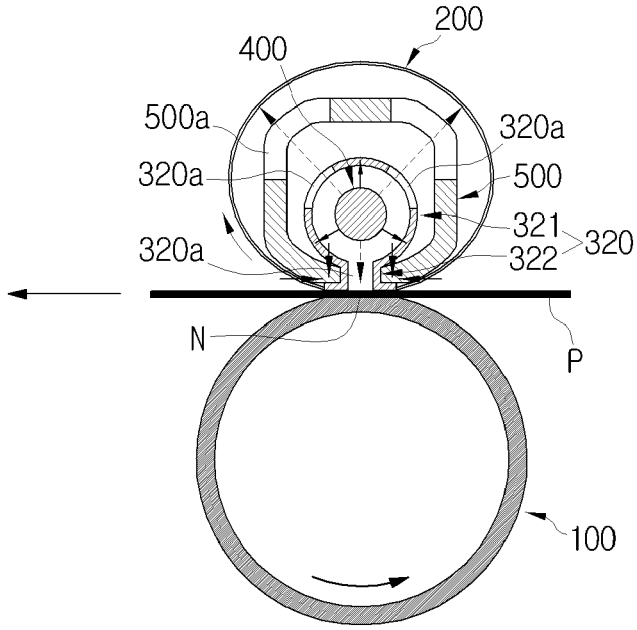
FIG. 5 is a sectional view illustrating an example of the configuration of the fixing device illustrated in FIG. 4 which includes a heat transmission unit in a nip zone of a nip forming member thereof.
Figure 6:
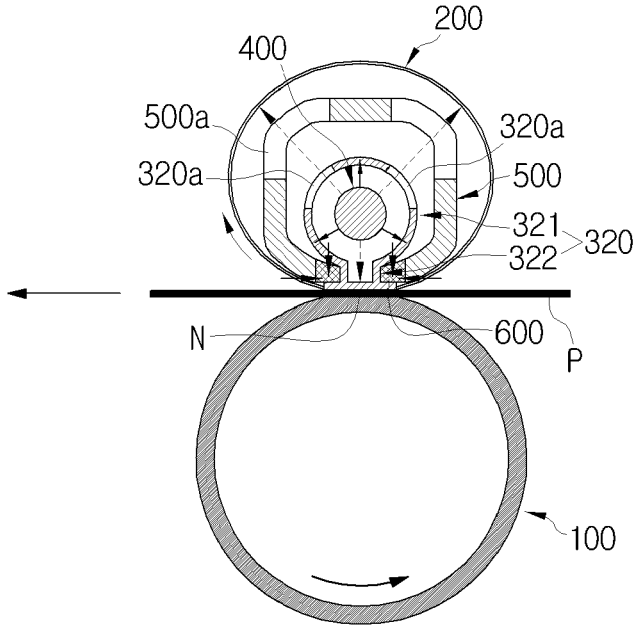
FIG. 6 is a sectional view illustrating an example of the configuration of the fixing device illustrated in FIG. 4 which includes a heat insulating member which is mounted at a contact area between the nip forming member and a supporting pressure member thereof.
Figure 7:
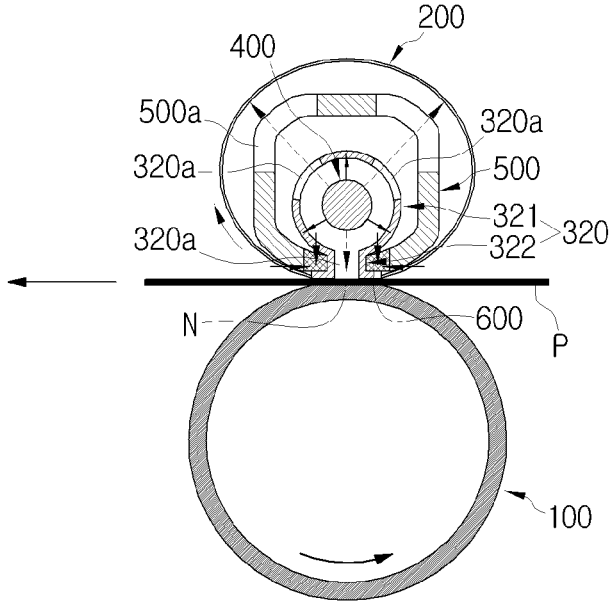
FIG. 7 is a sectional view illustrating an example of the configuration of the fixing device illustrated in FIG. 6 which includes a heat transmission unit in a nip zone of a nip forming member thereof.

FIG. 4 is a sectional view schematically illustrating a fixing device according to another exemplary embodiment of the present general inventive concept, FIG. 5 is a sectional view illustrating an example of the configuration of the fixing device illustrated in FIG. 4 which includes a heat transmission unit in a nip zone of a nip forming member thereof, FIG. 6 is a sectional view illustrating an example of the configuration of the fixing device illustrated in FIG. 4 which includes a heat insulating member which is mounted at a contact area between the nip forming member and a supporting pressure member thereof, and FIG. 7 is a sectional view illustrating an example of the configuration of the fixing device illustrated in FIG. 6 which includes a heat transmission unit in a nip zone of a nip forming member thereof.

As illustrated in FIGS. 4 to 7, a fixing device according to another exemplary embodiment of the present general inventive concept may include a pressing roller 100, a fixing belt 200, a nip forming member 320, a heat source 400, and a supporting pressure member 500. The pressing roller 100, the fixing belt 200, and the heat source 400 are similar as those of the exemplary embodiment of the present general inventive concept described with reference to FIGS. 2 and 3, so the same reference numerals have been used for the same elements and more detailed descriptions thereof are omitted.

The nip forming member 320 may be mounted inside the fixing belt 200 so that a nip N can be formed at a contact area between the pressing roller 100 and the fixing belt 200. The nip forming member 320 may be a metallic elastic body with a predetermined elasticity so that the pressurizing force acting on the pressing roller 100 can be adjusted.

The nip forming member 320 may include a body unit 321 having a substantially cylindrical shape to enclose the heat source 400, and a nip zone 322 which is provided on the body unit 321 so that a nip N can be formed at the contact area between the pressing roller 100 and the fixing belt 200. The body unit 321 may include a first heat transmission unit 320*a*, for example, a plurality of slits or holes, formed thereon. The plurality of slits or holes may have an elongated shape, and may be formed lengthwise along the outer surface of the body unit 321. The plurality of slits or holes may be spaced apart at a predetermined distance.

The nip zone 322 may be formed by extending a lower part of the body unit 321 to a predetermined length. Although the nip zone 322 of the nip forming member 320 according to the exemplary embodiment of the present general inventive concept illustrated in FIG. 4 extends downwardly from both ends of a lower part of the body unit 321, and bent outwards, the present general inventive concept is not limited thereto. Accordingly, the nip zone 322 may have various shapes. Although not illustrated in the drawings, one side of the nip zone 322 facing the pressing roller 100 may have a curved surface along an outer circumference of the pressing roller 100 in order to improve the fixing efficiency by increasing adhesion to the sheet of paper P. Alternatively, at least one projection may protrude towards the pressing roller 100 at the bottom surface of the nip zone 322 in order to easily feed and discharge sheets of paper P and to prevent the sheets of paper P from jamming. Additionally, referring to FIGS. 5 and 7, the first heat transmission unit 320*a* may also be formed in the nip zone 322 of the nip forming member 320, and accordingly the heat source 400 may directly apply heat to the fixing belt 200 through the first heat transmission unit 320*a* of the nip zone 322. Therefore, the heating rate of the fixing belt 200 can increase in the nip zone 322.

The supporting pressure member 500 may be mounted between the fixing belt 200 and the nip forming member 320, and may be a metallic rigid body having a predetermined rigidity in order to support and press the nip zone 322 of the nip forming member 320. More specifically, the supporting pressure member 500 may be formed to enclose the nip forming member 320, and both ends of a lower part of the supporting pressure member 500 may provide equal support to the nip zone 322 of the nip forming member 320 along the axis, while pressing the nip zone 322 towards the pressing roller 100. The supporting pressure member 500 may be fixed on a fixing frame (not illustrated) of the fixing device in order to guide the rotation of the fixing belt 200.

The supporting pressure member 500 may include a second heat transmission unit 500*a*, for example a plurality of slits or holes. The plurality of slits or holes may have an elongated shape, and may be formed lengthwise along the outer surface of the supporting pressure member 500. The plurality of slits or holes may be spaced apart at a predetermined distance. Each second heat transmission unit 500*a* may be disposed in a direction from the heat source corresponding to the direction of each first heat transmission unit 320*a*. The second heat transmission unit 500*a* may be larger than the first heat transmission unit 320*a*

As illustrated in FIGS. 6 and 7, the fixing device according to another exemplary embodiment of the present general inventive concept may further include a heat insulating member 600 to prevent heat from being transferred from the nip forming member 320. The heat insulating member 600 may be placed at a contact area between the nip forming member 320 and the supporting pressure member 500, and may be formed integrally with the supporting pressure member 500. The heat insulating member 600 may be made of a material, such as rubber or resin, with a lower thermal conductivity than that of the nip forming member 320.

The operation of the fixing device according to the above exemplary embodiment of the present general inventive concept is the same as those of the exemplary embodiment described with reference to FIGS. 2 and 3, so detailed description thereof is omitted. However, according to the above exemplary embodiment, the heat emitted from the heat source 400 may be applied to the nip forming member 320 and at a same time may be directly applied to the fixing belt 200 through the first and second heat transmission units 320*a* and 500*a*. Accordingly, a rapid temperature increase and thermal stability can be achieved, and thus high-speed printing can be realized.

Additionally, the supporting pressure member 500 may support the nip zone 322 of the nip forming member 320 while pressing the nip zone 322 of the nip forming member 320 towards the pressing roller 100, and therefore the nip width can be stably maintained and the fixing properties can be thereby improved. Furthermore, the supporting pressure member 500 may provide equal support to the nip zone 322 of the nip forming member 320 along the axis, and thus it is possible to prevent the nip forming member 320 from being bent.

Figure 8:
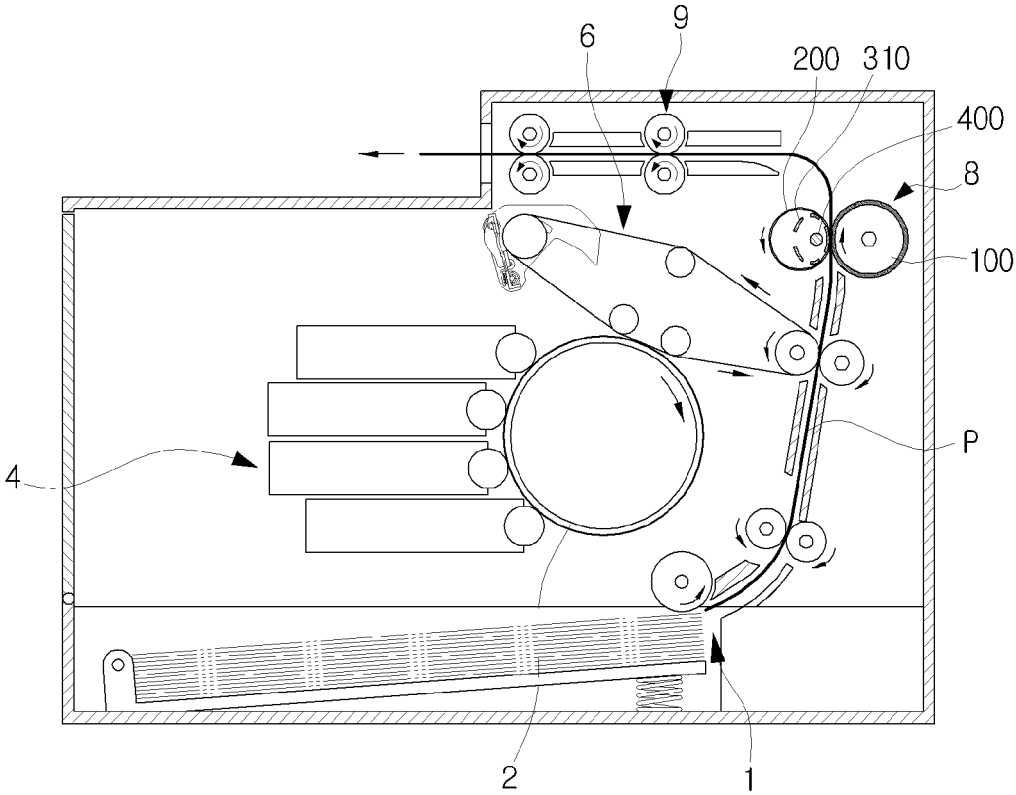
FIG. 8 is an exemplary view schematically illustrating an image forming apparatus including a fixing device according to exemplary embodiments of the present general inventive concept.

As illustrated in FIG. 8, an image forming apparatus according to exemplary embodiments of the present general inventive concept may include a feeding device 1, a photoconductive medium 2, a developing device 4 to attach a developer onto an electrostatic latent image on the photoconductive medium 2 and to develop the electrostatic latent image, a transferring device 6 to transfer an image developed on the photosensitive medium 2 by the developing device 4 to a printing medium P, a fixing device 8, as configured in accordance with the present general inventive concept described above, to fix the image transferred to the printing medium P, and a discharging device 9. The feeding device 1, the photoconductive medium 2, the developing device 4, the transferring device 6, and the discharging device 9 are known to those skilled in the art, so more detailed descriptions thereof are omitted.

As described above, according to exemplary embodiments of the present general inventive concept, the fixing belt and the nip zone may be directly heated using heat emitted from the heat source, so that a rapid temperature increase and thermal stability can be achieved, and thus high-speed printing can be realized.

Additionally, the nip forming member may be made of an elastic body with a predetermined elasticity, and accordingly it is possible to adjust a pressurizing force acting on the pressing roller.

Furthermore, the supporting pressure member may provide equal support to the nip zone of the nip forming member along the axis while pressing the nip zone of the nip forming member towards the pressing roller, and thus it is possible to prevent the nip forming member from being bent, and the nip width can be stably maintained, thereby improving the fixing properties.

In addition, the fixing device may include the heat insulating member to prevent heat being transferred from the nip forming member to the supporting pressure member, and accordingly the heating rate of the fixing belt can increase in the nip zone.

Moreover, the heat transmission unit may be formed in the nip zone of the nip forming member, to directly apply the heat emitted from the heat source to the fixing belt through the heat transmission unit, and thus it is possible to increase the heating rate of the fixing belt in the nip zone.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A fixing device, comprising:

a pressing roller;

a fixing belt to receive a rotation force transferred from the pressing roller and to rotate thereby;

a nip forming member which is mounted inside the fixing belt and forms a nip, the nip forming member comprising a heat transmission unit formed thereon; and a heat source, which is mounted inside the nip forming member, to simultaneously apply heat to the nip forming member and to the fixing belt through the heat transmission unit, such that the heat transmission unit simultaneously heats the fixing belt at the nip and other portions thereof.

2. The fixing device as claimed in claim 1, wherein the nip forming member is fixed to guide the rotation of the fixing belt.

3. The fixing device as claimed in claim 1, wherein the nip forming member has a substantially cylindrical shape.

4. The fixing device as claimed in claim 1, wherein the nip forming member comprises an elastic body with a predetermined elasticity.

5. The fixing device as claimed in claim 1, wherein the heat transmission unit of the nip forming member is formed in a nip zone in the nip forming member.

6. The fixing device as claimed in claim 1, wherein the heat transmission unit comprises a plurality of slits or holes.

7. A fixing device, comprising:

a pressing roller;

a fixing belt to receive a rotation force transferred from the pressing roller and to rotate thereby;

a nip forming member which is mounted inside the fixing belt and forms a nip, the nip forming member comprising a first heat transmission unit formed thereon;

a supporting pressure member, which is mounted between the fixing belt and the nip forming member, to support and press the nip forming member, the supporting pressure member comprising a second heat transmission unit formed thereon; and a heat source, which is mounted inside the nip forming member, to simultaneously apply heat to the nip forming member and to the fixing belt through the first and second heat transmission units, such that the heat transmission units simultaneously heat the fixing belt at the nip and other portions thereof.

8. The fixing device as claimed in claim 7, wherein the nip forming member is formed to enclose the heat source, and the nip forming member comprises a body unit comprising the first heat transmission unit, and a nip zone, which is formed in the body unit, to form a nip at a contact area between the pressing roller and the fixing belt.

9. The fixing device as claimed in claim 8, wherein the nip zone of the nip forming member is formed by a lower part of the body unit being extended to a predetermined length.

10. The fixing device as claimed in claim 9, wherein the nip zone is formed by both ends of the lower part of the body unit being extended downwards and bent outwards.

11. The fixing device as claimed in claim 7, wherein the nip forming member comprises an elastic body with a predetermined elasticity.

12. The fixing device as claimed in claim 7, wherein the first heat transmission unit of the nip forming member is formed in the nip zone in the nip forming member.

13. The fixing device as claimed in claim 7, wherein the supporting pressure member is fixed in order to guide rotation of the fixing belt.

14. The fixing device as claimed in claim 7, wherein the supporting pressure member provides equal support to the nip zone of the nip forming member along the axis while pressing the nip zone of the nip forming member towards the pressing roller.

15. The fixing device as claimed in claim 7, wherein the supporting pressure member comprises a rigid body with a predetermined rigidity.

16. The fixing device as claimed in claim 7, wherein the first and second heat transmission units comprise a plurality of first and second heat transmission units respectively, and each second heat transmission unit is disposed in a direction from the heat source corresponding to the direction of a respective first heat transmission unit.

17. The fixing device as claimed in claim 7, wherein the first and second heat transmission units comprise a plurality of slits or holes.

18. The fixing device as claimed in claim 7, further comprising a heat insulating member to prevent heat being transferred from the nip forming member to the supporting pressure member.

19. The fixing device as claimed in claim 18, wherein the heat insulating member is placed at a contact area between the nip forming member and the supporting pressure member.

20. The fixing device as claimed in claim 19, wherein the heat insulating member is formed integrally with the supporting pressure member.

21. The fixing device as claimed in claim 18, wherein the heat insulating member has a lower thermal conductivity than the nip forming member.

22. The fixing device as claimed in claim 21, wherein the heat insulating member comprises one of rubber and resin.

23. A fixing device, comprising:

a pressing roller;

a fixing belt to receive a rotation force transferred from the pressing roller and to rotate thereby;

a nip forming member which is mounted inside the fixing belt and forms a nip, the nip forming member comprising a heat transmission unit formed thereon;

a supporting pressure member to support and press a nip zone of the nip forming member; and a heat source, which is mounted inside the nip forming member, to simultaneously apply heat to the nip forming member and to the fixing belt through the heat transmission unit, such that the heat transmission unit simultaneously heats the fixing belt at the nip and other portions thereof.

24. An image forming apparatus comprising:

a photoconductive drum;

a developing device to attach a developer onto an electrostatic latent image on the photoconductive medium and to develop the electrostatic latent image;

a transferring device to transfer an image developed on the photosensitive medium by the developing device to a printing medium; and a fixing device to fix the image transferred to the printing medium, wherein the fixing device comprises:

a pressing roller;

a fixing belt to receive a rotation force transferred from the pressing roller and to rotate thereby;

a nip forming member which is mounted inside the fixing belt forms a nip, the nip forming member comprising a heat transmission unit formed thereon; and a heat source, which is mounted inside the nip forming member, to simultaneously apply heat to the nip forming member and to the fixing belt through the heat transmission unit, such that the heat transmission unit simultaneously heats the fixing belt at the nip and other portions thereof.

25. The image forming apparatus as claimed in claim 24, wherein the nip forming member is fixed to guide the rotation of the fixing belt.

26. The image forming apparatus as claimed in claim 24, wherein the nip forming member has a substantially cylindrical shape.

27. The image forming apparatus as claimed in claim 24, wherein the nip forming member comprises an elastic body with a predetermined elasticity.

28. The image forming apparatus as claimed in claim 24, wherein the heat transmission unit of the nip forming member is formed in a nip zone in the nip forming member.

29. The image forming apparatus as claimed in claim 24, wherein the heat transmission unit comprises a plurality of slits or holes.

30. An image forming apparatus comprising:

a photoconductive drum;

a developing device to attach a developer onto an electrostatic latent image on the photoconductive medium and to develop the electrostatic latent image;

a transferring device to transfer an image developed on the photosensitive medium by the developing device to a printing medium; and a fixing device to fix the image transferred to the printing medium, wherein the fixing device comprises:

a pressing roller;

a fixing belt to receive a rotation force transferred from the pressing roller and to rotate thereby;

a nip forming member which is mounted inside the fixing belt and forms a nip, the nip forming member comprising a first heat transmission unit formed thereon;

a supporting pressure member, which is mounted between the fixing belt and the nip forming member, to support and press the nip forming member, the supporting pressure member comprising a second heat transmission unit formed thereon; and a heat source, which is mounted inside the nip forming member, to simultaneously apply heat to the nip forming member and to the fixing belt through the first and second heat transmission units, such that the heat transmission units simultaneously heat the fixing belt at the nip and other portions thereof.

31. A fixing device, comprising:

a pressing roller;

a fixing member to receive a rotation force transferred from the pressing roller and to rotate thereby;

a nip forming member housed inside the fixing belt, the nip forming member comprising a heat transmission unit formed thereon; and a heat source mounted inside the nip forming member to simultaneously apply heat to the nip forming member and partially emanate heat unobstructively and simultaneously towards the entire fixing belt through the heat transmission unit.

32. The fixing device of claim 31, wherein the heat transmission unit constitutes multiple open outer surfaces on the nip forming member.

* * * * *